US006273274B1

(12) United States Patent
Lyles

(10) Patent No.: US 6,273,274 B1
(45) Date of Patent: Aug. 14, 2001

(54) FOLDED CAP HOLDER

(76) Inventor: Anthony Lyles, 1702 E. 123rd Pl., Sauk Valley, IL (US) 60411

( * ) Notice: Subject to any disclaimer, the term of this patent is extended or adjusted under 35 U.S.C. 154(b) by 0 days.

(21) Appl. No.: 09/645,839

(22) Filed: Aug. 25, 2000

(51) Int. Cl.[7] ..... A47F 7/00
(52) U.S. Cl. ..... 211/30; 211/32; 211/113
(58) Field of Search ..... 211/30, 32, 87.01, 211/113

(56) References Cited

U.S. PATENT DOCUMENTS 4,993,557 * 2/1991 Davis ..... 211/30
5,086,931 * 2/1992 Cobb ..... 211/32
5,244,102 * 9/1993 Koenig ..... 211/32
5,344,003 * 9/1994 Park .
5,348,166 * 9/1994 Lema ..... 211/30
5,683,002 * 11/1997 Rayside ..... 211/30
5,685,465 * 11/1997 Berardis ..... 211/30 X
5,758,779 * 6/1998 Atkins ..... 211/32

* cited by examiner

*Primary Examiner*—Robert W. Gibson, Jr.
(74) *Attorney, Agent, or Firm*—Fitch, Even, Tabin & Flannery

(57) ABSTRACT

A cap holder for holding a plurality of folded nested caps having a bill and a foldable crown. The cap holder comprises a frame, a crown support mounted to the frame for holding the nested, folded crowns, and a bill support mounted on the frame which forms an open pocket to receive the cap bills. The crown support comprises a vertical, curved and outwardly projecting column on the frame to fit in the hollow of a folded cap crown and the bill support comprises a band of material with an arcuate mouth portion spaced from the column to define an open mouth to receive cap the bill.

16 Claims, 2 Drawing Sheets

FOLDED CAP HOLDER

FIELD OF THE INVENTION

This invention relates to a holder for holding a plurality of caps having a foldable crown and a bill.

BACKGROUND OF THE INVENTION

Many people have a substantial collection of billed caps often called "baseball caps" that must be stored somewhere as in a closet. A large collection of billed caps takes considerable space and it is desired to support the stored cap so that its shape is not damaged during storage. Billed baseball caps are extremely popular as they are inexpensive and often bear a logo of a sporting team, such as a baseball team, a football team, a hockey team, etc. Other billed baseball caps may bear the logo of a farm implement or feed supplier or various other kinds of companies. A large number of billed caps bear the name of a vacation spot or exotic location visited by a traveler. Still other billed caps with or without logos are purchased because of fashion or color and material appear to the purchaser. Thus, a family often has a large collection of billed caps for men, women and children that need to be stored.

Preferably, the storage of such billed caps displays the caps to the owner so that the owner may easily select the desired cap from the stored cap collection without having to sort through all of the caps to find the desired cap. Further, the cap holder should preferably be inexpensive and compact. It should be inexpensive so that a purchaser may buy it on impulse, or buy it for oneself or as an inexpensive gift for another. Closet space is at a premium and, hence, the cap holder and stored caps should be closet friendly and compact. The cap holder, of course, need not be used only in a closet, but may be positioned in many places other than a closet.

SUMMARY OF THE INVENTION

In accordance with the present invention, a plurality of nested, billed caps having their crowns folded and nested one within the other are inserted into an open pocket of a cap holder mounted to a frame or sheet. The open pocket has a surface for supporting the nested bills and a surface for supporting the folded, nested crowns extending rearwardly toward the support sheet. It is preferred to support the rear-curved side of the rear one of the folded crowns with an outwardly projecting crown support surface projecting into the hollow end of the rear one of the nested caps.

In accordance with an important aspect of the invention, a plurality of folded cap receiving pockets are provided on the backing sheet, which can either be stored flat or horizontal, but is also supplied, in the preferred embodiment described herein, with a hook to be hung vertically as in a closet. The folded cap receiving pockets also may be made of different sizes such as for storing children's size caps, as well as adult size caps. Herein, this is achieved by making a wider pocket and cap support for the adult size caps and a narrower pocket and cap support for the children size caps.

The illustrated folded cap holder is inexpensive and compact in that it is formed with a flat backing support preferably in sheet form with outwardly projecting crown support thereon which projects into the hollow at the rear of the nested folded caps. The nested bills of the folded caps are supported by a vertically inclined bill support surface having an upper, large, open and at the pocket mouth into which the nested cap bills are inserted and then moved downwardly within the pocket. As the cap bills are being inserted into the pocket, the rear curved hollow of the nested crowns are supported by the crown support. The crown support herein is curved and projects into a hollow in the folded crown of the last of the folded nested caps. The bill support is preferably a strip or band of material that is widely spaced from the curved crown support at its upper edge at the mouth of the pocket and abutting or closely adjacent the crown support at its lower edge at the bottom of the pocket. Herein, the bill support is a band of elastic material and the curved bill support is a curved, padded column with upper and lower elastic bands extending there-across to define upper and lower pockets, each for receiving nested, folded crown caps therein.

DETAILED DESCRIPTION OF THE PREFERRED EMBODIMENT OF THE INVENTION

Figure 1:
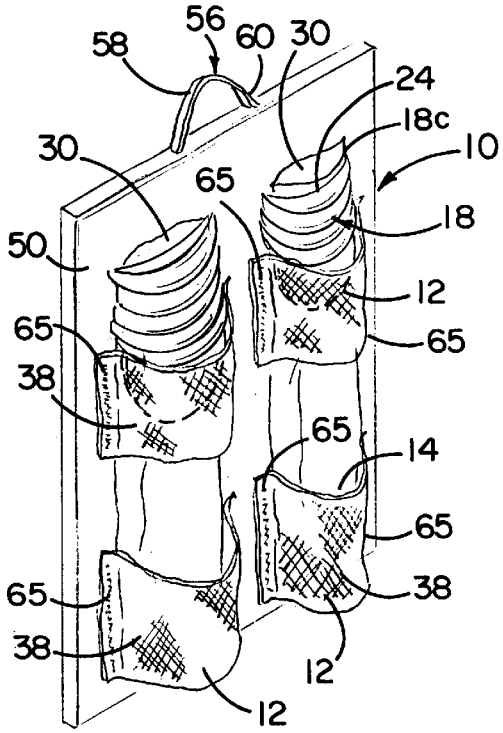
FIG. 1 is a perspective view of a cap holder holding nested, folded caps and constructed in accordance with a preferred embodiment of the invention.
Figure 2:
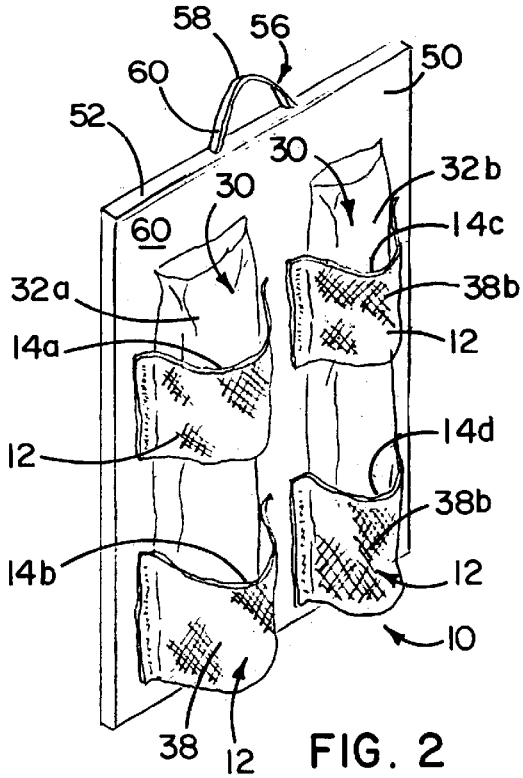
FIG. 2 is a perspective view of the cap holder of FIG. 1 without caps.
Figure 3:
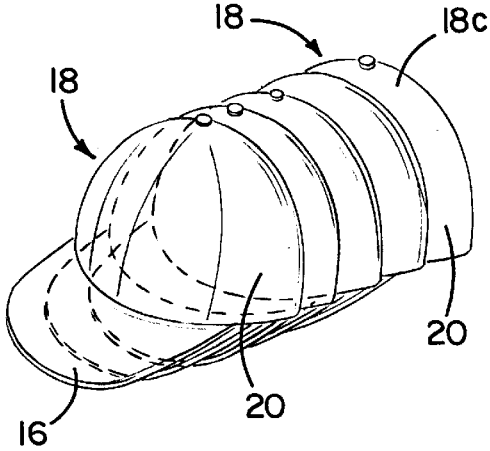
FIG. 3 is a perspective view of a plurality of nested, folded caps having bills for use with the cap holder.
Figure 4:
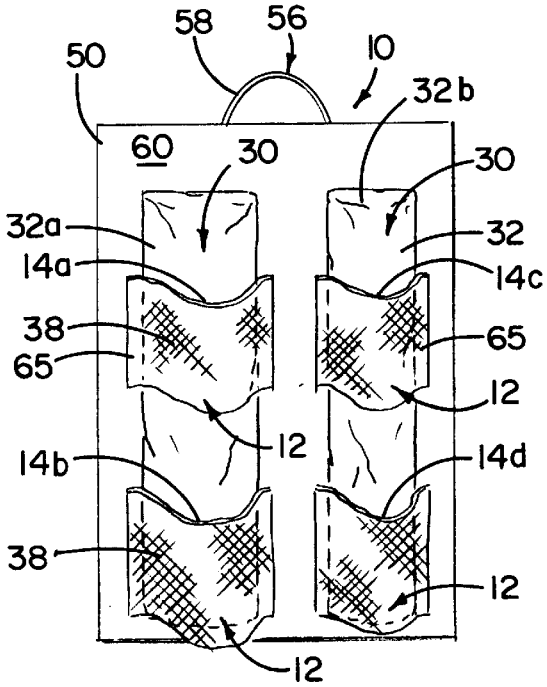
FIG. 4 is a front view of the cap holder.
Figure 5:
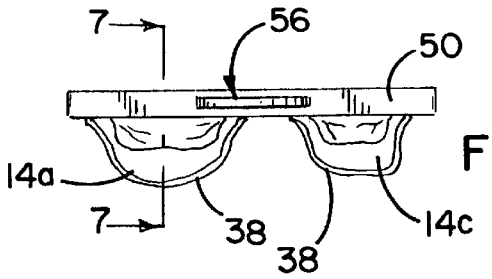
FIG. 5 is a top view of the cap holder.
Figure 6:
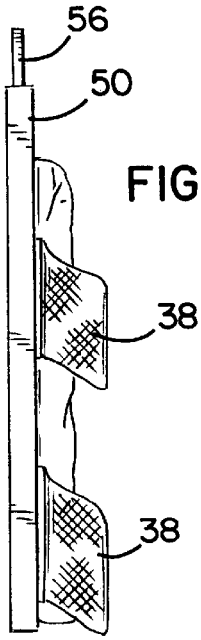
FIG. 6 is a side view of the cap holder.
Figure 7:
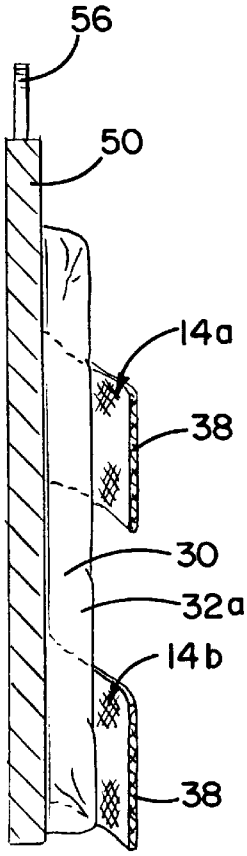
FIG. 7 is a sectional view through the cap holder.

As shown in the drawings for purposes of illustration, the invention is embodied in a cap holder 10 having at least one bill support 12 and a pocket 14 for receiving bills 16 of nested caps 18 having folded crowns 20. Herein, a plurality of billed caps are nested one within another with the bills laying one on another and with each of the cap crowns folded in half and nested. The folding of the crowns creates a hollow or rounded space 24 at the rear of each crown and a hollow 24 at the back one 18c of the folded, nested caps.

Figure 8:
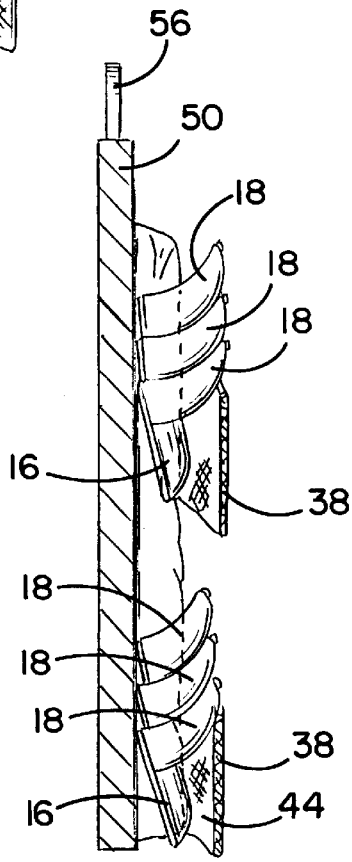
FIG. 8 is a sectional view similar to FIG. 7, but with caps in a pocket of the cap holder.

In accordance with the illustrated embodiment of the invention, the rear of the nested, folded caps 18 are supported by a crown support 30 which preferably projects outwardly into the hollow 24 of the rear one 18*c* of the nested folded caps. Herein, the crown support comprises a rounded or curved portion of a vertical column 32 or 34 which has an upper and lower pocket 14*a,* 14*b* or 14*c,* 14*d* for receiving nested folded caps therein. The upper and lower pockets are inexpensively formed of a strap or strip 38 of material extending laterally across and spaced from the associated vertical column 32 to define the pocket 14 having an upper open mouth 40 leading to a hollow space between the strip 38 and the column 32. Preferably, the strip is inclined downwardly and inwardly, as best seen in FIG. 8, to define a pocket decreasing volume from the upper mouth to the bottom of the pocket. The bill of the forward one of the nested caps engages and is supported by an inner side wall 44 of the strip.

In order to accommodate both childrens' caps and adults' caps, it is preferred to provide two different sizes of cap supports 12 on the same cap holder 10. This is achieved by making the column 32*b* and the strip 38*b* of lesser size in the lateral direction to define smaller pockets 14*c* and 14*d* for childrens' caps. The wider column 32*a* and the wider strip 38*a* define larger size pockets 14*a* and 14*b* for the larger adult size caps. Manifestly, the cap holder may have all children-sized pockets or all adult-sized pockets or various other sizes of pockets.

For the purpose of supporting and mounting the cap holders 10 in either a horizontal or vertical position or at some inclination thereto, the cap holder is provided with a frame 50 herein in the shape of a flat sheet 52 that is covered in vinyl, or the like. The illustrated sheet 52 is rectangular and is relatively thin and made of an inexpensive material such as plastic, paperboard, or the like. A hanging device 56 is associated with the sheet to hang the sheet in a closet or other place such as along a vertical wall by a hook 58 in the form of a short-looped strap 60 having an opening to receive a nail, or the like. The short-looped strap is centered and attached at opposite ends to the sheet 52 at the upper edge of the sheet. Manifestly, other devices could be used to mount or support the sheet 52 in a vertical orientation and fall within the purview of the invention. The cap holder also may be laid flat in a horizontal position, if one does not want to hang it.

The crown supports 30 for supporting the crown of the rear one of the folded caps is made inexpensively of a pad of foam plastic, or the like, with an outer curved side and a rear flat side secured to the face of the backing sheet 52. Herein, the crown supports are made in two strips or columns 32, 34 that are parallel to one another and have a different width between their respective vertical edges 32*c*, 32*d* and 34*c* and 34*d* to support adult and children-size crowns, respectively. Herein, for aesthetic purposes, a covering sheet 60 of vinyl or the like covers the columns 32 and the entire front face of the backing sheet.

The illustrated bill supporting strips 38*a* and 38*b* have their laterally side edges 65 secured to the backing sheet 52 in a suitable manner. Herein, the strips extend only to the vertical edges 32*c*, 32*d* and 34*c* and 34*d* of the respective crown support columns. The bill support strips are made of inexpensive elastic material of a plastic or cloth-like material. The bill supports may be formed in other manner than the illustrated strips 38 and 38*b* disclosed herein.

From the foregoing, it will be seen that there has been provided an inexpensive and compact cap holder for holding nested, folded crown, billed caps. Both the bills and folded crowns are supported in the preferred embodiment. Preferably, the crown support is curved and projects into the curved hollow space in the folded crown of the rear one of the nested caps; but the crown support could merely be a portion of the flat backing sheet without the curved projecting pad illustrated in the described embodiment of the invention. These and other variations may be made to this cap holder invention without departing from the scope of the invention, as defined by the appended claims.

What is claimed is:

1. A cap holder for holding a plurality of folded, nested caps having a bill and foldable crown, the cap holder comprising:

a frame;

a crown support mounted on the frame for holding the nested folded crowns and having a portion for fitting within a hollow of a folded crown of the rear one of the nested caps; and a bill support mounted on the frame comprising a band of flexible material attached at opposite ends of said frame, wherein said band of flexible material provides an open pocket to receive the cap bill with the bill extending downwardly in the pocket and with the curved folded cap crowns supported by the crown support.

2. A cap holder for folded, nested caps in accordance with claim 1 wherein the bill support comprises a band of material having an upper pocket mouth portion with a predetermined length of curvature and a lower tip portion to receive the tip of the cap brim with a substantially shorter length of curvature, thereby providing a pocket with a downwardly-decreasing volume.

3. A cap holder for folded, nested caps in accordance with claim 1 wherein:

the crown support comprises a vertical, curved and outwardly projecting column on the frame to fit in the hollow of a folded cap crown; and the bill support comprises a band of material with an arcuate mouth portion spaced from the column to define an open mouth to receive the cap bill.

4. A cap holder for folded, nested caps in accordance with claim 3 comprising:

an arcuate curved portion on the column extending vertically to receive the curved hollow in the folded crown of the rear cap at the back of the pocket; and the band of material for the bill support extending down and inclined inwardly from the upper open mouth to adjacent the bottom of the pocket.

5. A cap holder for folded, nested caps in accordance with claim 4 wherein the band of material comprises a band of elastic material expandable to accommodate more cap bills therein.

6. A cap holder for folded, nested caps in accordance with claim 3 wherein the cap holder comprises a first size and a second size of bill supports on the frame associated with a projecting column for holding a plurality of folded caps of adult size and of children size.

7. A cap holder for folded, nested caps in accordance with claim 3 comprising:

a plurality of crown supports mounted on the frame; and a plurality of bill supports associated with each column to form at least four pockets for holding folded crown caps.

8. A cap holder for folded, nested caps in accordance with claim 7 wherein:

the frame comprises a rigid sheet having a covering thereon;

the crown supports comprise a pair of parallel columns having a curved, projecting forward side and having back sides fixed to the sheet and extending vertically along the sheet; and the bill supports comprise a pair of upper and lower bands of elastic material which are mounted on the sheet and extend across and are spaced from each of the respective columns to define pockets with their associated column to receive the bills and folded crowns of nested, folded caps.

9. A cap holder for holding a plurality of nested, folded caps having a bill and a crown which can be folded, the folded cap holder comprising:

a backing sheet;

at least one bill support made of flexible material mounted on the backing sheet with a portion thereof sized and shaped to support a bill of the forward one of the nested caps and spaced from the sheet to define an open pocket to receive the downwardly directed bills of the nested, folded caps; and an inclined surface on the bill support being spaced from the backing sheet having an upper end at a greater distance from the sheet than its lower end to define a pocket with a decreasing volume in the vertical direction.

10. A cap holder for holding a plurality of nested, folded caps having a bill and a crown which can be folded, the folded cap holder comprising:

a backing sheet;

at least one bill support mounted on the backing sheet with a portion thereof sized and shaped to support a bill of the forward one of the nested caps and spaced from the sheet to define an open pocket to receive the downwardly directed bills of the nested, folded caps;

an inclined surface on the bill support being spaced from the backing sheet having an upper end at a greater distance from the sheet than its lower end to define a pocket with a decreasing volume in the vertical direction; and a crown support mounted on the sheet and located at the back of the pocket and projecting outwardly into the pocket to project into a hollow space within a rear one of the nested, folded crowns.

11. A cap holder for folded, nested caps in accordance with claim 10 comprising:

a plurality of bill supports on the backing support each for holding a plurality of nested folded caps therein.

12. A cap holder for folded caps in accordance with claim 10 wherein the crown supports comprise at least one support surface projecting outwardly from the backing sheet and into a hollow space at the rear of the crown of the back one of the nested, folded crowns in the pocket.

13. A cap holder for folded caps in accordance with claim 11 wherein the crown supports comprise a pair of arcuate padded columns extending vertically along the backing sheet; and the bill supports comprise a pair of upper and lower bands extending laterally across and spaced from their associated arcuate padded column to define a pocket therewith.

14. A cap holder for folded caps in accordance with claim 13 wherein the upper and lower bands are elastic.

15. A cap holder for folded caps in accordance with claim 13 wherein:

one of said crown supports is sized to support wider crowns of folded, nested crowns of adult-sized caps; and the other of said crown supports is sized narrower to support narrow crowns of folded, nested crowns of child-sized caps.

16. A cap holder for holding a plurality of nested, folded caps in accordance with claim 9, wherein a plurality of caps may be stored in the open pocket of the bill support.

* * * * *